US006234785B1

(12) United States Patent
Kim et al.

(10) Patent No.: US 6,234,785 B1
(45) Date of Patent: May 22, 2001

(54) SWIRLER PLATE IN GAS BURNER

(75) Inventors: In Kyu Kim; Young Soo Kim; Yang Ho Kim, all of Kyongsangnam-do; Kyeong Su Kim, Pusan-kwangyok, all of (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 09/447,048

(22) Filed: Nov. 23, 1999

(30) Foreign Application Priority Data

Nov. 23, 1998 (KR) ..... 1998-50189
Nov. 23, 1998 (KR) ..... 1998-50190
Feb. 18, 1999 (KR) ..... 1999-2467

(51) Int. Cl.[7] ..... F23Q 3/00
(52) U.S. Cl. ..... 431/265; 431/183; 431/349; 431/350
(58) Field of Search ..... 431/263, 265, 431/9, 354, 349, 350, 183, 181, 186; 239/406, 405, 425.5, 423

(56) References Cited

U.S. PATENT DOCUMENTS 1,971,554 * 8/1934 Forster ..... 431/349
3,061,001 * 10/1962 Reed ..... 431/349
3,320,999 * 5/1967 Stalego ..... 431/349
4,397,631 * 8/1983 Fisher ..... 431/350

* cited by examiner

*Primary Examiner*—James C. Yeung
(74) *Attorney, Agent, or Firm*—Fleshner & Kim, LLP

(57) ABSTRACT

Swirler plate in a gas burner, the swirler plate having a plurality of slits formed in a radial direction for supplying a mixed gas to a combustion chamber, and a plurality of swirl vanes formed on one side of the slits for guiding the mixed gas from the slits to the combustion chamber, including a swirl vane for a flame detector having an angle of a slope formed lower than angles of slopes of other swirl vanes, the swirl vane for a flame detector having a combustion main reaction region in which the flame detector is fitted.

20 Claims, 11 Drawing Sheets

SWIRLER PLATE IN GAS BURNER

BACKGROUND OF THE INVENTION

1. Field of the Invention

The present invention relates to a gas burner, and more particularly, to a swirler plate in a gas burner in which gas is burnt.

2. Background of the Related Art

In general, the gas burner is an appliance for burning a gas (LNG, LPG, and the like) for room heating and etc., using a heat from the combustion. A related art gas burner will be explained with reference to FIGS. 1 and 2.

There are a suction grill 2 in a lower portion of a body 1 for drawing external air, a discharge grill 3 for discharging heated air having a heat exchanged in the gas burner in an upper portion, a combustion chamber 4 in the body 1 for burning gas, a fan housing 5 for placing a fan 5*a* under the combustion chamber, and a heat exchanger 7 above the combustion chamber. And, there is a gas discharge pipe 8 connected to the heat exchanger for discharging exhaust gas to outside of the room an air supply pipe 9 connected to the combustion chamber, and a fan 9*a* at an outlet of the air supply pipe 9 for drawing air.

In the meantime, there is a burner unit in the combustion chamber 4 for mixing air and gas, and igniting the mixed gas, to make a flame, to which a gas supply pipe 6 is connected. The burner unit will be explained in detail with reference to FIGS. 3~5.

There is a draft tube 20 provided with a nozzle 10 having a plurality of gas spray holes 11 at an end thereof for mixing gas and air and supplying the mixed gas to the combustion chamber, a flame detector 30 and an ignition plug 40, one end of each of which is passed through the draft tube and projected into the combustion chamber. The draft tube 20 has a tube body 21 and a swirler plate 22 formed as a unit in front of the tube body. The swirler plate 22 has a plurality of slits 23 formed in a radial direction for supplying the mixed gas to the combustion chamber, and swirl vanes 24 on one side of the slits 23 for guiding the mixed gas toward the combustion chamber. The swirl vanes 24 are oriented in one direction and have the same slopes, for providing the mixed gas discharged through the slits with a circulating force to make a smooth mix of the gas and the air, and a strong injection force to the mixed gas. Accordingly, external air and gas are mixed in the draft tube 20, and injected into the combustion chamber 4 through the slits 23 in the swirler plate 22. The gas sprayed through the gas spray holes 11 in the nozzle can be directed to the slits 23 smoothly because the orientation of the slits 23 in the swirler plate is within a spray span of the gas sprayed through the gas spray holes 11 in the nozzle. That is, since an end of the nozzle 10 having the gas spray holes formed therein is sloped an angle, such that a direction of the gas spray hole 11 corresponds to a direction of the slits 23. The ignition plug 40 ignites the mixed gas sprayed into the combustion chamber, the flame detector 30 determines an occurrence of a flame, which is in general of an AC flame detection type using an FET (Field Effect Transistor). That is, ignition, i.e., occurrence of the flame is detected by the flame detector 30 and the ignition plug 40 is controlled according to a result of detection.

The operation of the gas burner will be explained.

Upon putting the gas burner into operation, a controller (not shown) controls an air supply fan 9*a* to rotate, to draw external air and gas. The drawn air and gas are mixed appropriately and sprayed into the combustion chamber 4 through the slits 23. The mixed gas sprayed into the combustion chamber is ignited by the ignition plug 40 to form flame in the combustion chamber 4. The flame detector 30 detects the flame ignited initially and inputs to the controller, so that the controller compares a value of the flame detection to a present flame reference value. If it is determined that the mixed gas is ignited normally as a result of the comparison, operation of the ignition plug 40 is stopped so that no more flame is formed. That is, the flame detector 30 measures a flame voltage of the mixed gas, to determine formation of the flame and a state of the flame during operation.

In the meantime as shown in FIG. 4, the flame at the swirl vane diverges, to form a combustion main reaction region 'B'(a region the flame voltage caused by flame ions is the highest) at outer periphery, and there is almost no flame voltage in other regions. However, the flame detector 30 can be positioned, not in the combustion main reaction region of the slit(called as "a first slit". Defined as "flame detector swirl vane") 23*b*, but in combustion main reaction region of a slit (called as a second slit)23*b* right before the first slit 23*a*. Accordingly, the flame detector detects formation of a flame discharged through the second slit.

A structure of the burner unit for the related art gas burner has the following problems.

First, accurate detection fo flame formation and a flame state have been difficult in the related art. Because, as explained, the flame detector detects a flame, not at the first slit, but at the second slit. However, the flame discharged through the second slit is directed upward by a second swirl vane slope, such that the flame detector can detect only a portion of the flame form a region of an intensive flame, to fail an accurate detection of formation of the flame (see FIG. 6). Due to this, in order to solve this problem in the related art, a shape of the flame detector is modified, or an overall height of the flame detector is made higher, However, the above measure pushes up a cost since the flame detector is expensive, and has problems in view of fabrication, i.e., fastening of the flame detector and swirler plate, formation the flame detector. The elevation of the overall height of the flame detector rather causes malfunction for influences of external environment, such as noise signal, deformation coming from a prolonged use, and interference with other components.

Second, though the gas burner is required to maintain a flame constant during operation, the related art gas burner has occasions in which the flame is either unstable or out due to a momentary drop of a gas pressure. Because a momentary flow of much air through the air supply pipe causes a momentary low pressure of the supplied gas, with a sharp reduction of discharge fuel, that increases a fuel to air ratio, to result in an unstable flame or flame out.

Third, the poor ignition performance of the related art gas burner has occasions in which ignition is delayed or failed due to poor ignition. Because the related art swirl vanes 24*b* of a planar form sprays the mixed gas evenly throughout the slit 23*b*, that causes discharged ignition nuclei not to concentration on an end of the ignition plug, but dispersed(see FIG. 5).

SUMMARY OF THE INVENTION

Accordingly, the present invention is directed to a swirler plate in a gas burner that substantially obviates one or more of the problems due to limitations and disadvantages of the related art.

An object of the present invention is to provide a swirler plate in a gas burner, which can improve a detecting performance of a flame in a combustion chamber.

Other object of the present invention is to provide a swirler plate in a gas burner, which can improve a stability of flame.

Another object of the present invention is to provide a swirler plate in a gas burner, which can improve an ignition performance.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the swirler plate in a gas burner, having a plurality of slits formed in a redial direction for supplying a mixed gas to a combustion chamber, and a plurality of swirl vanes formed on one side of the slits for guiding the mixed gas from the slits to the combustion chamber, includes a swirl vane for a flame detector having an angle of a slope formed lower than angles of slopes of other swirl vanes, the swirl vane for a flame detector having a combustion main reaction region in which the flame detector is fitted.

A plurality of supplementary swirl holes are provided in a central portion of the swirler plate.

An electric field concentrating means formed in the swirl vane for the ignition plug disposed right before the ignition plug among swirl vanes for concentrating an electric field.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
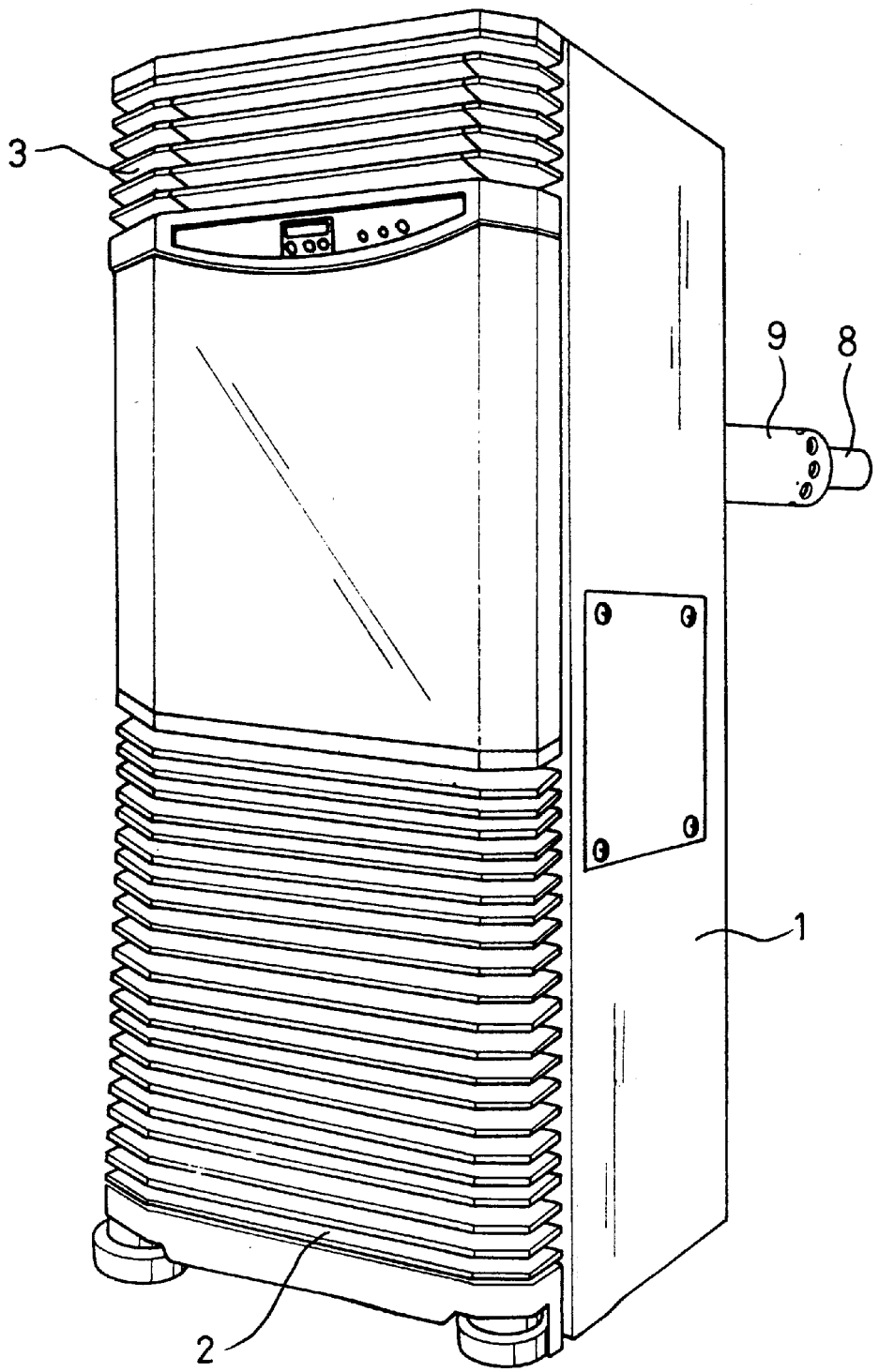
FIG. 1 Related Art
FIG. 1 illustrates a perspective view of a related art gas burner.
Figure 2:
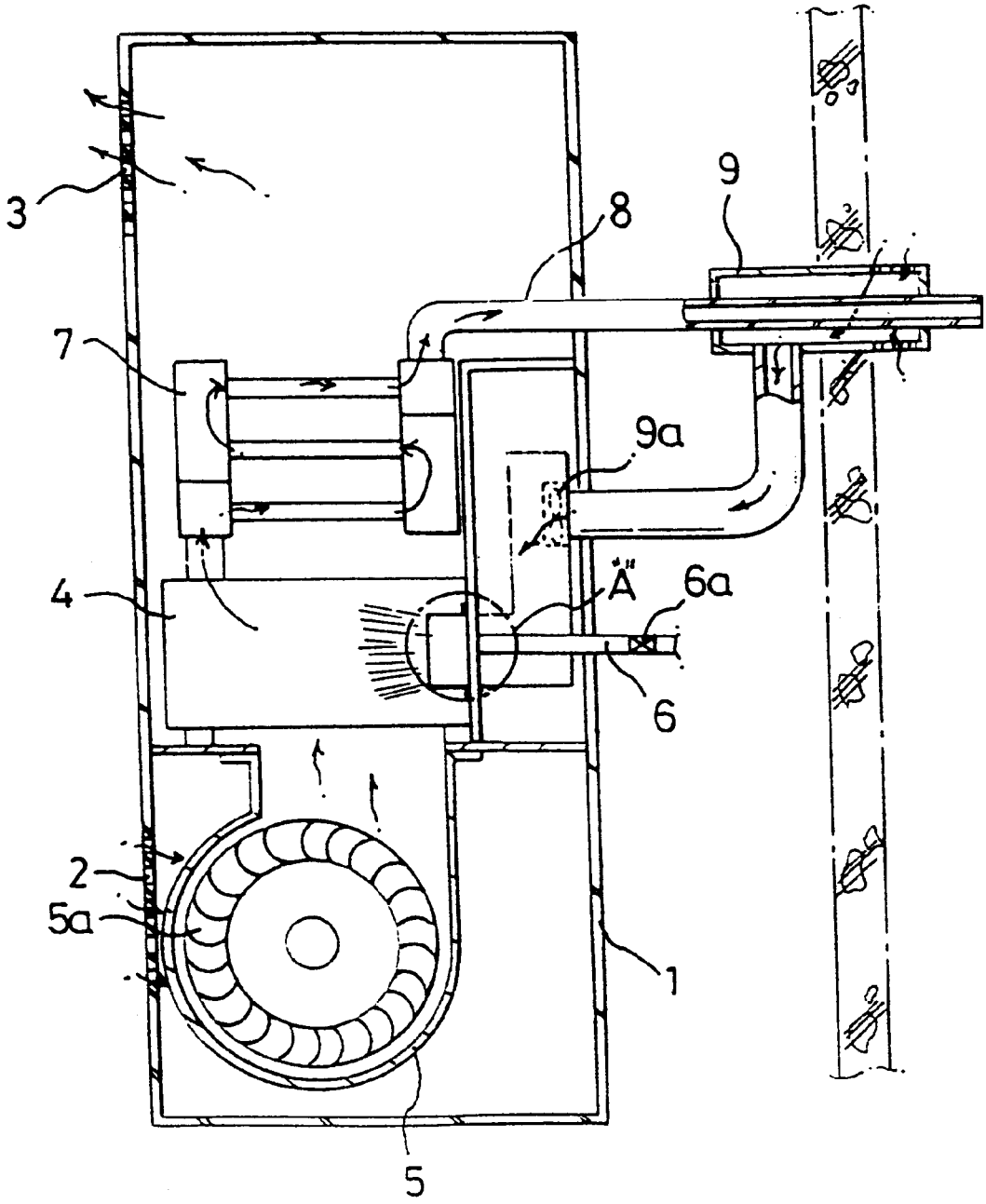
FIG. 2 Related Art
FIG. 2 illustrates a section of the related art gas burner in FIG. 1.
Figure 3:
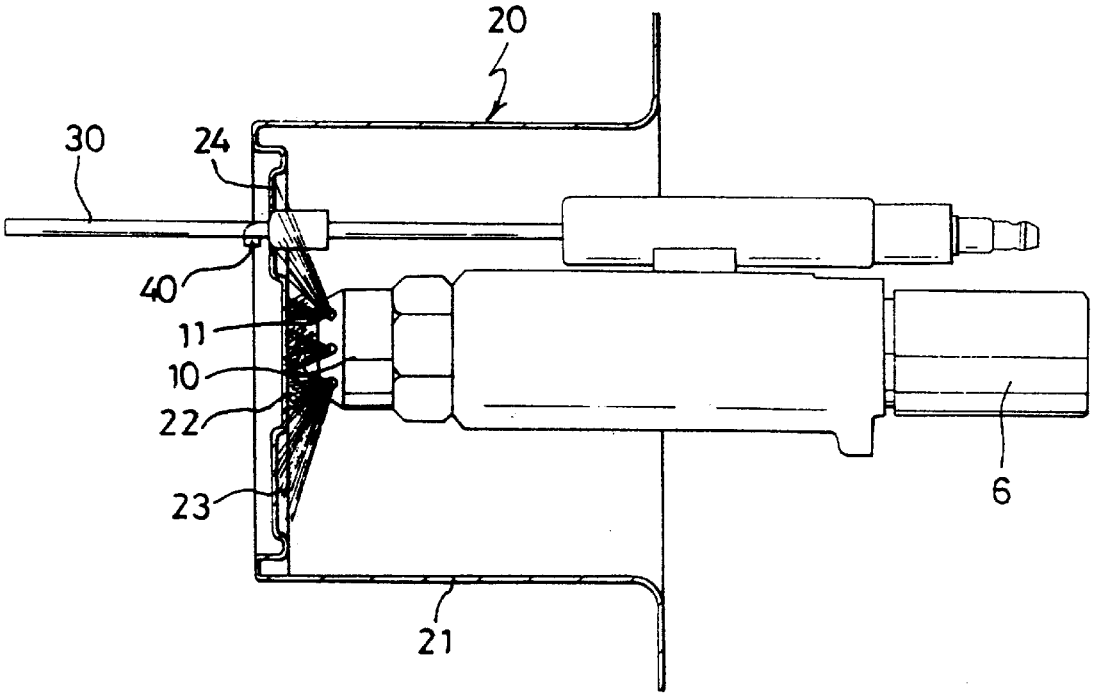
FIG. 3 Related Art
FIG. 3 illustrates an enlarged sectional view of "A" part in FIG. 2.
Figure 4:
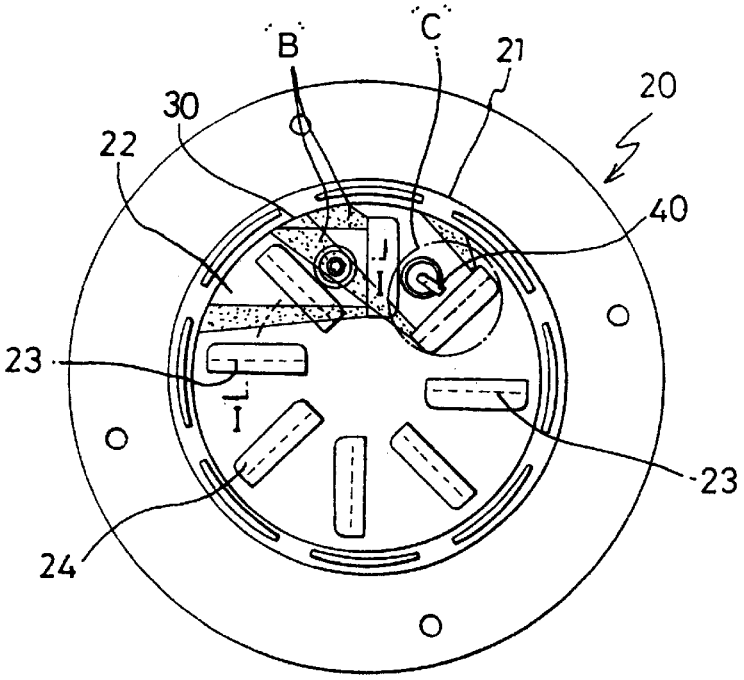
FIG. 4 Related Art
FIG. 4 illustrates a front view of FIG. 3.
Figure 5:
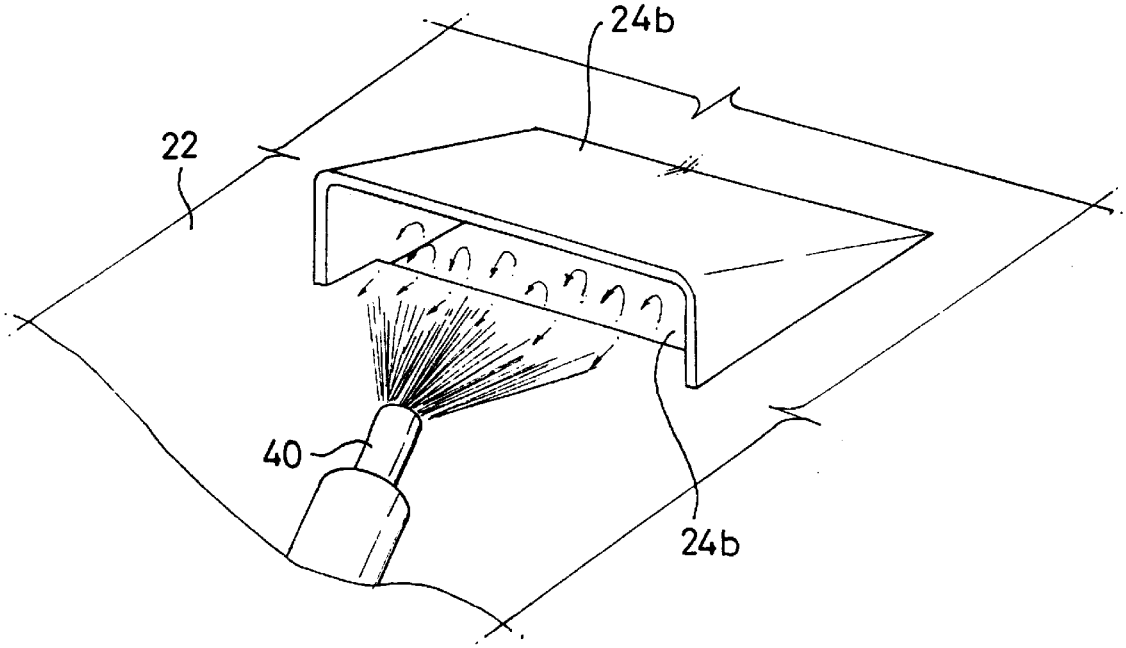
FIG. 5 Related Art
FIG. 5 illustrates a perspective view of a "C" part in FIG. 4.
Figure 6:
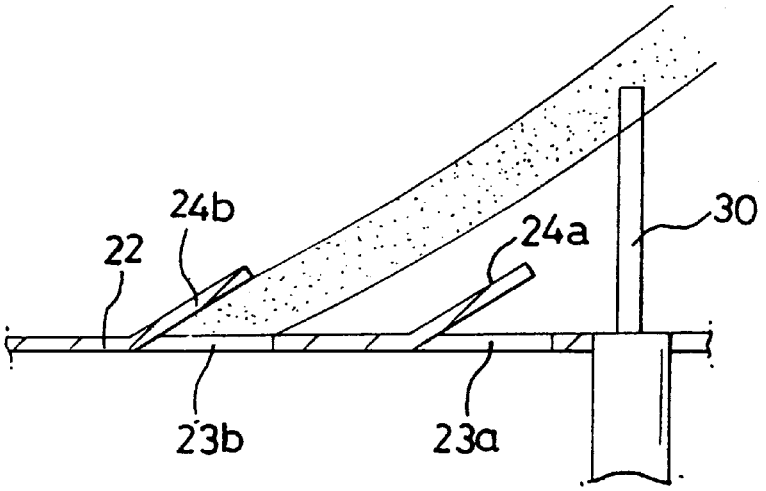
FIG. 6 Related Art
FIG. 6 illustrates a section across line I—I in FIG. 4.
Figure 7:
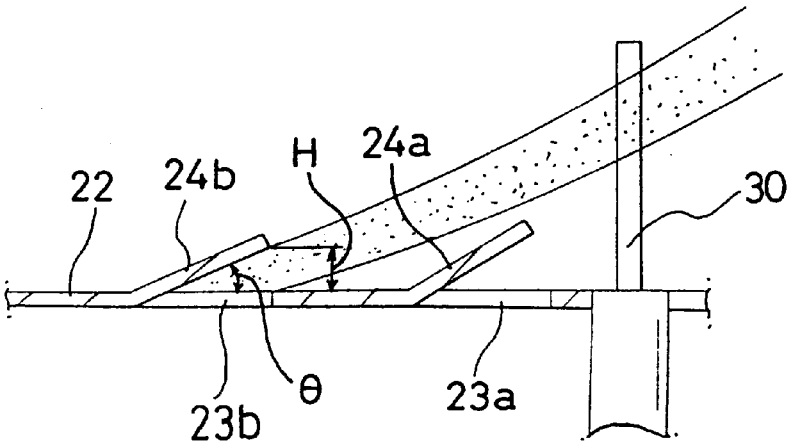
FIG. 7 illustrates a section showing a swirler plate in a gas burner in accordance with a first embodiment of the present invention, which correspond to FIG. 6.

Reference will now be made in detail to the preferred embodiments of the present invention, examples of which are illustrated in the accompanying drawings. Components of the present invention identical to the related art will be given the same reference symbols, and explanations for the identical components will be omitted. A first embodiment of the present invention will be explained with reference to FIG. 7.

The first embodiment of the present invention is substantially identical to the related art, except that the first embodiment suggests to form one of a plurality of swirl vanes formed on a swirler plate 22 to have a smaller slope θ or Height H than others for accurate detection of a flame by a flame detector. That is, the first embodiment suggests to form a slope angle of only one swirl vane smaller to permit an accurate flame detection without deterioration of a stability of flame and a combustion efficiency by maintaining a total flame release the same. In detail, as explained in the related art, because the flame detector 30 is positioned in a combustion main reaction region of flame of the second swirl vane 24*b* positioned in front of a first swirl vane 24*a*, an angle of a slope of the second swirl vane 24*b* is formed smaller than other swirl vanes. By doing this, the flame by the second swirl vane 24*b* can be sprayed into the combustion main reaction region where is the flame detector 30, with, in general, forming an angle of a slope smaller than the flame by the first swirl vane 24*a*, to increase a contact surface between the flame detector and the flame, that improves a stability of the flame voltage detection. And, formation of flame can be measured accurately even if a quantity of heat release is not great, since the flame detector can detect a flame voltage of a high voltage band. In detail, in general, a flame has two kinds of structure; a periphery has red color while an interior of the flame has blue or white, which come form differences of temperature and energy. Provided that the flame detector can be brought into contact with the interior of a flame, the flame detection can be done very accurately. The inventors of the present invention noticed this. That is, the flame by the fist swirl vane 24 is pressed by a flow by the second swirl vane 121 because the angle of slope θ of the second swirl vane 24*b* is formed low, such that an interior of the flame by the first swirl vane is brought into contact with a lower portion of the flame detector and the flame by the second swirl vane itself is lowered to be brought into contact with an upper portion of the flame detector. According to this, as the flame detector is brought into contact with the flame in overall, an accurate flame detection is made available. The angle of slope θ of the second swirl vane 24*b* is formed smaller than other swirl vanes preferably by approx. 20~50%, and more preferably by approx. 30%. Because, if the angle of slope of the second swirl vane 24*b* is smaller by more than 50%, all the strong flame region guided by the second swirl vane can not be within the measuring region of the flame detector 30, but a portion of the flame region is out of the measuring region the same as a case of the related art. And, when the angle of slope θ of the second swirl vane is not lower by more than approx. 20% of other angle of slopes, a smooth discharge of flame can not be made, such that the flame is out of a measuring range of the flame detector.

Figure 10A:
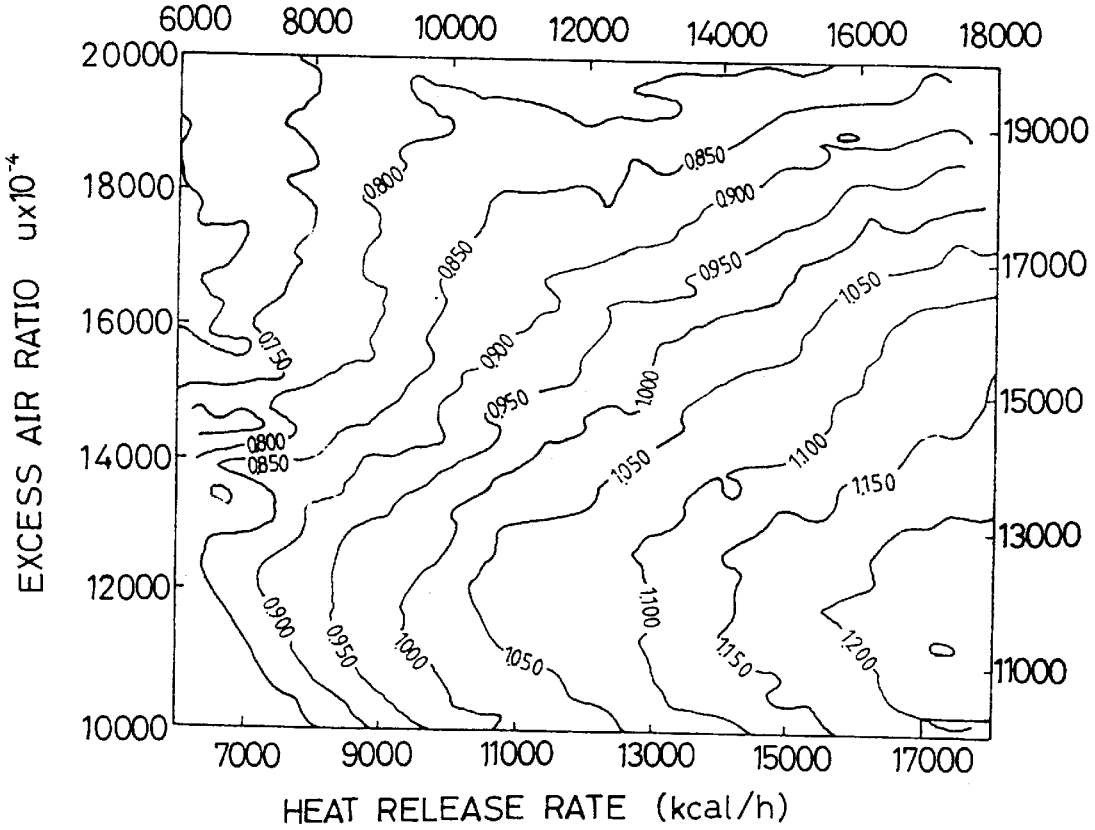
FIGS. 10A and 10B illustrate a flame voltage vs. a heat release rate and an excess air ratio, for the related art gas burner (FIG. 10A) and the first embodiment gas burner of the present invention(FIG. 10B), respectively.
Figure 10B:
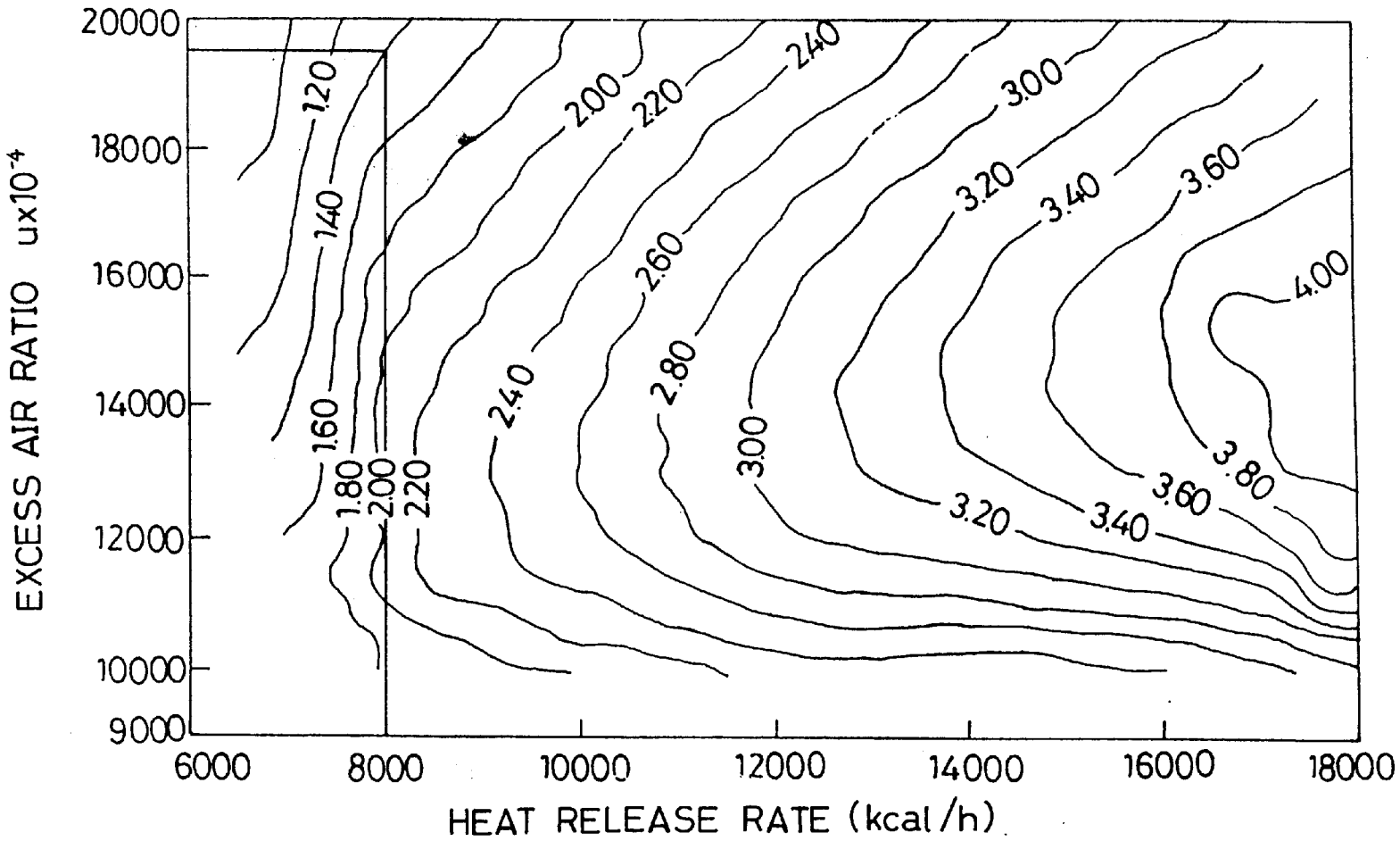

Referring to FIGS. 10A and 10B, the related art gas burner detects a voltage in a range of approx. 1.2V only when an excess air ratio is low(approx. 1 time) and a heat release rate is high(17000 kcal/h). As the gas burner of the present invention can detects a voltage in a range of approx. 1.4V, even if the excess air ratio is high(appprox. two times) and a heat release rate is low, facilitating an accurate and fast measurement of flame formation.

Figure 8:
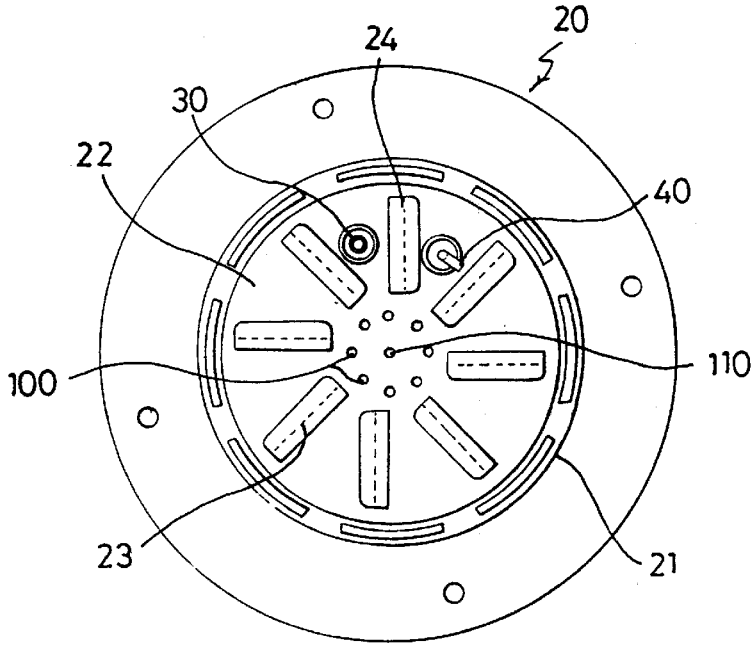
FIG. 8 illustrates a front view showing a swirler plate in a gas burner in accordance with a second embodiment of the present invention, which corresponds to FIG. 4.

A second embodiment swirler plate in a gas burner of the present invention will be explained with reference to FIG. 8.

The second embodiment of the present invention suggests to provide a plurality of supplementary swirl holes 100 in a center portion of the swirl plate, i.e., inside of the slits 23. The supplementary swirl holes 100 are formed along a circle in a radial direction, preferably in correspondence to a direction of the gas spray holes 11 in the nozzle, substantially. Preferably, there is also one supplementary swirl hole at a center of the swirl plate(called, "center supplementary swirl hole") 110. The supplementary swirl hole 100 preferably has a diameter within one to three times of a thickness of the swirl plate 22. For example, when the swirl plate 22 has a thickness of 1 mm, the supplementary swirl hole has a diameter of 1~3 mm. Appropriate diameter of the supplementary swirl hole 100 sized according to the thickness of the swirler plate facilitates an equilibrium between a quantity of the mixed gas discharged through the supplementary swirl hole and a burning rate of the mixed gas. That is, if the diameter of the supplementary swirl hole is greater than three times of the thickness of the swirler plate, the quantity of mixed gas discharged through the supplementary swirl holes is greater than the burning rate of the flame, resulting in an unstable formation of flame. And, if the diameter of the supplementary swirl hole is smaller than the thickness of the swirler plate, the discharge of the mixed gas through the supplementary swirl holes becomes not smooth in comparison to the burning rate of the flame, resulting in a formation of flame which is not smooth.

The operation of the swirler plate in a gas burner in accordance with a second embodiment of the present invention will be explained.

As the supplementary swirl holes 100 have small diameters, when the gas burner is put into operation, most of the mixed gas is discharged through the supplementary swirl holes 100. And, since the supplementary swirl holes are positioned within a range of gas discharge of the gas spray holes 11 in the nozzle 10, a smooth discharge is possible. If a gas pressure is dropped from an external influence during combustion, a quantity of the gas discharged into the combustion chamber 4 through the slits 23 will be reduced, to increase a relative flow rate of the air than a flow rate of the gas, resulting in an unstable flame formed through the slits 23. However, since the flame formed at the supplementary swirl holes 100 are stable continuously, the flame is not out, but maintained. Because the supplementary flame holed have comparatively small diameters, and are positioned close to the gas spray holes 11 in the nozzle 10, the gas can be still supplied to the supplementary swirl holes 100 even if the gas pressure is dropped sharply.

Figure 11:
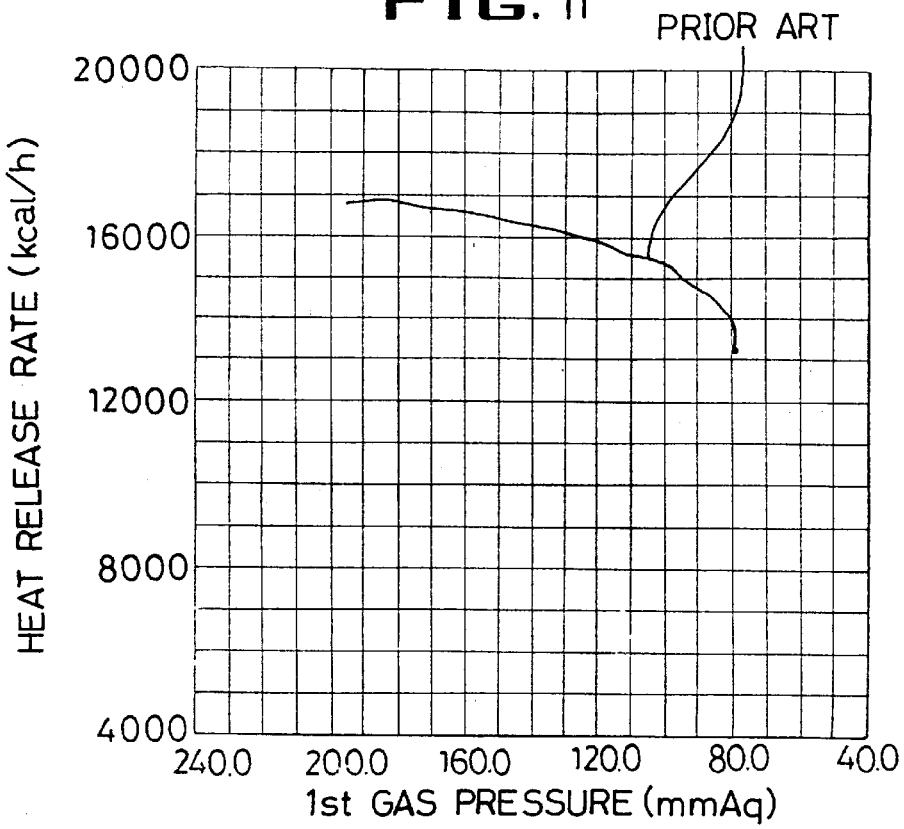
FIG. 11 illustrates a graph shown an influence of gas pressure in a burner unit to a flame, for a related art gas burner and the second embodiment gas burner.
Figure 11:
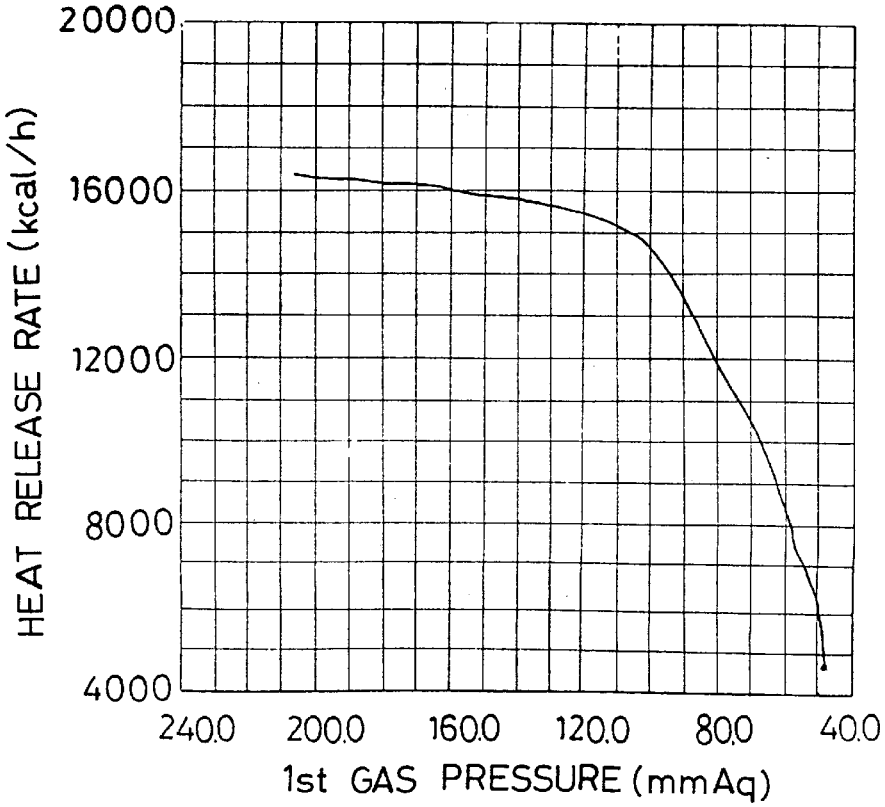

Referring to FIG. 11, it can be known that, though the related art gas burner without the supplementary swirl holes shows a flame out when the gas pressure is approx. 80 mmAq, the gas burner of this embodiment can still maintain the flame even if the gas pressure reaches to approx. 40 mmAq. Provided that the flame can be maintained continuously, a stable combustion can be made available when a gas supply pressure is increased again to increase a gas quantity again, that permits to reignite the mixed gas discharged through the slits by means of the flame maintained owing to the supplementary swirl holes. In the meantime it is necessary to assemble the nozzle and the draft tube such that centers both fo the nozzle and the draft tube are brought coincident for smoother gas spray, which bring about a stable flame. The center supplementary swirl hole 110 serves for, not only improving flame maintenance effect the same with the other supplementary swirl holes 100, but also facilitating verification of the coincidence of the centers of the nozzle and the draft tube when the nozzle 10 and the draft tube 20 are assembled.

Figure 9:
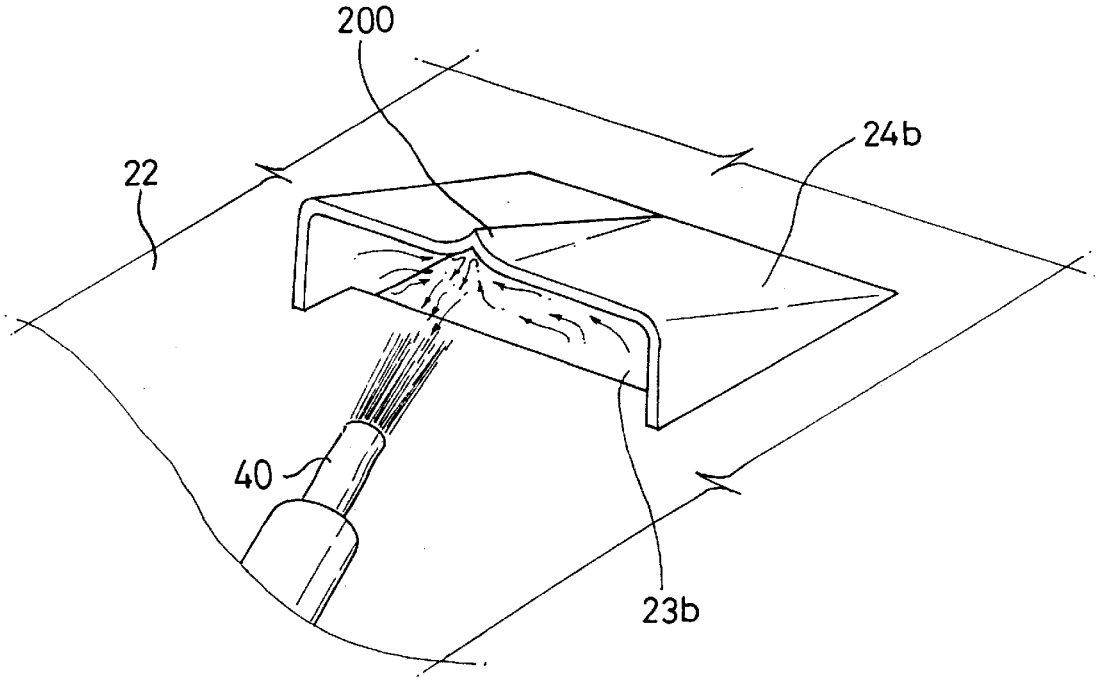
FIG. 9 illustrates a section showing a swirler plate in a gas burner in accordance with a third embodiment of the present invention, which corresponds to FIG. 5.

A third embodiment of the present invention will be explained with reference to FIG. 9.

The third embodiment of the present invention suggests to provide a swirler plate in a gas burner having an electric field concentrating means 200 in a swirl vane formed right before an ignition plug, i.e., a second swirl vane 24*b*(called as "ignition plug swirl vane" hereafter) for concentrating a mixed gas discharged toward the ignition plug 40. The electric field concentrating means 200 employs a phenomenon in which an electric field concentrates at a portion where is a sharp change of a sectional area. Therefore, the electric field concentrating means 100 may be provided by providing a sharp change in a sectional area of the swirl vane which serves as a discharge objective of the ignition plug. Though it is possible that formation of the electric field concentrating means 200 through out the second swirl vane 24*b*, it is preferable that the electric field concentrating means 200 is provided only in a portion of the second swirl vane, if it is taken into consideration that the mixed gas is discharged even after the ignition is achieved. In detail, a projection is provided on a top surface fo the second swirl vane 24*b* for use as the electric field concentrating means 200, to which sparks of the ignition plug are to be concentrated. AS shown in FIG. 9, as a preferred embodiment, the electric filed concentrating means 200 has a triangular section with an upward slope as it goes to an end of the second swirl vane 24*b*. And, the electric filed concentrating means 200 may be formed, not as a unit with the second swirl vane 24*b*, but separately.

The function of this embodiment will be explained.

Figure 12:
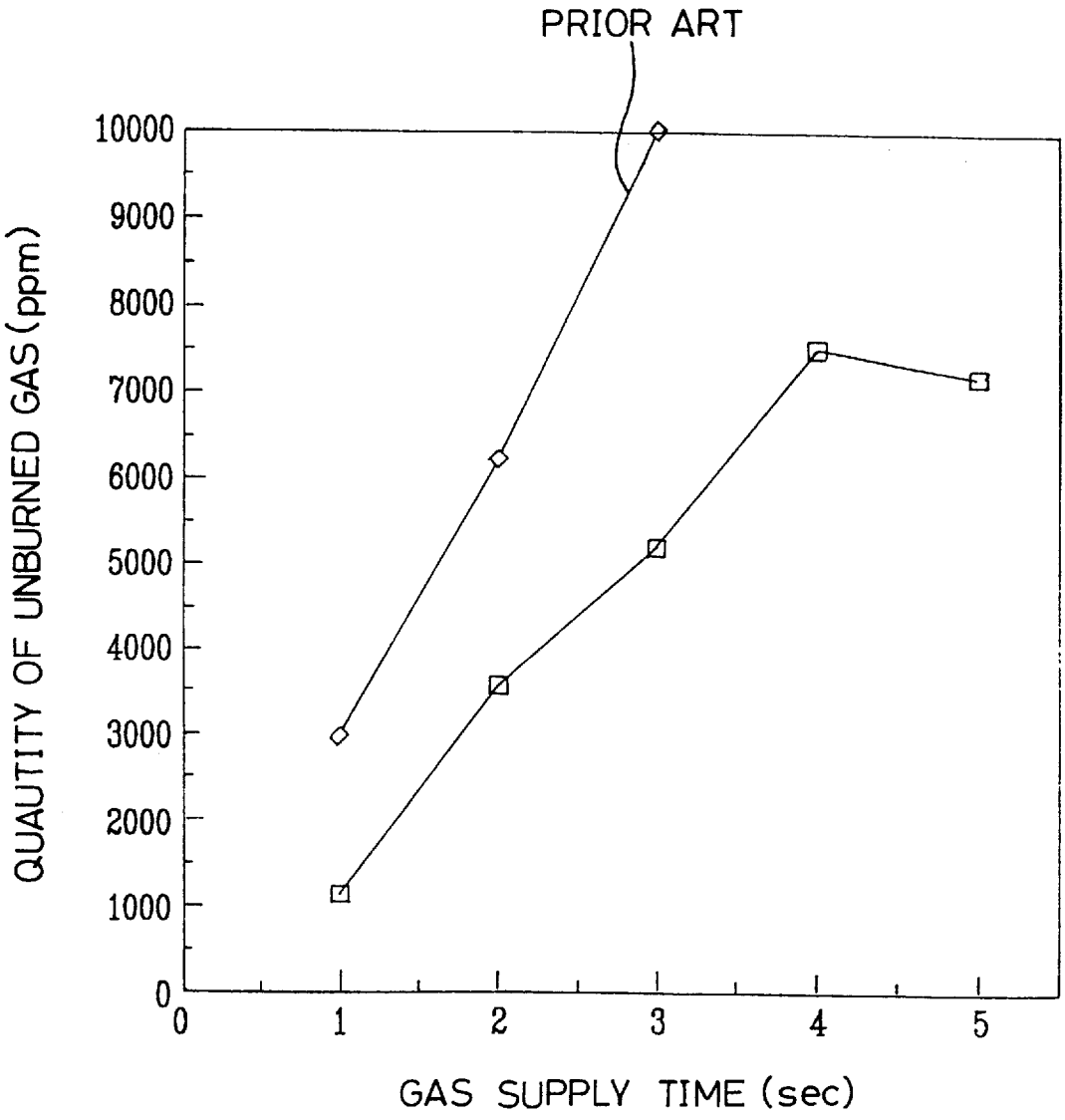
FIG. 12 illustrates a graph showing variation of gas quantity supplied in ignition vs. a quantity of unburned gas, for the related art and the third embodiment; and, FIG. 13 illustrates a graph showing a flare voltage vs. ignition time, for the related art and the third embodiment of the present invention.
Figure 13:
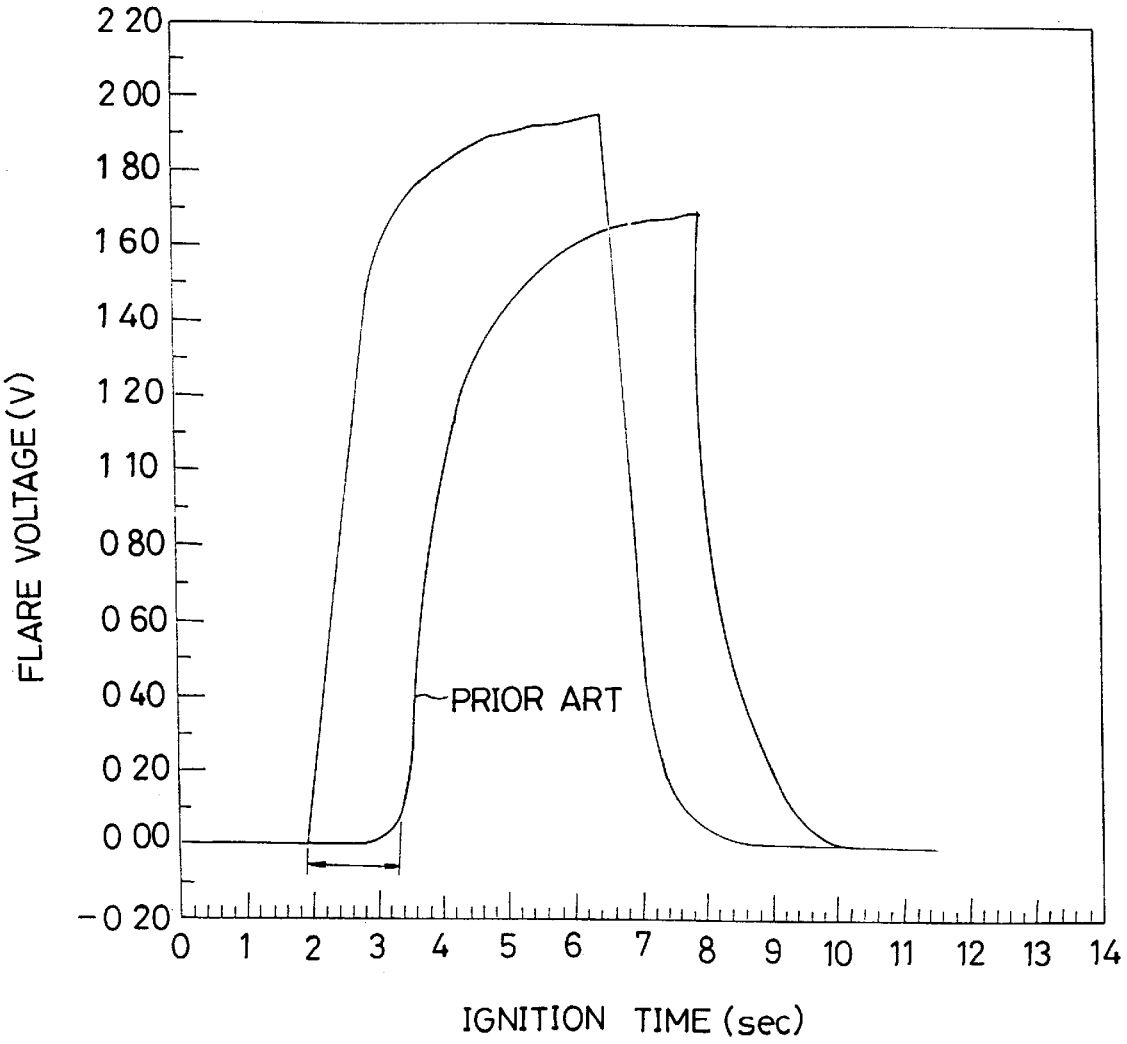

When the gas burner is put into operation, since the mixed gas discharged toward the ignition plug is guided by the electric field concentrating means 200 on the second swirl vane such that the mixed gas is concentrated at a central portion of the mixed gas, the mixed gas is concentrated to an end of the ignition plug. As a discharge range of ignition nuclei is concentrated to the end side of the ignition plug 40, smoother ignition can be achieved. As shown in FIG. 12, it can be known that the present invention can reduce a quantity of unburned gas substantially for a quantity of gas supplied during ignition in comparison to the related art, which implies that the ignition is fast in comparison to the related art and a smoother combustion is possible. And, as shown in FIG. 13, it can be known that the swirler plate in a gas burner of the present invention can make a fast ignition with an extremely short ignition time lag, and has an excellent ignition performance compared to the related art.

It will be apparent to those skilled in the art that various modifications and variations can be made in the swirler plate in a gas burner of the present invention without departing from the spirit or scope of the invention. Thus, it is intended that the present invention cover the modifications and variations of this invention provided they come within the scope of the appended claims and their equivalents.

What is claimed is:

1. A swirler plate for a gas burner, the swirler plate having a plurality of slits for supplying a mixed gas to a combustion chamber, comprising:

a plurality of swirl vanes formed on one side of the slits for guiding the mixed gas from the slits to the combustion chamber, wherein the swirl vanes are configured to guide the mixed gas into the combustion chamber such that the mixed gas swirls around a central axis of the swirler plate; and a plurality of supplementary swirl holes in a central portion of the swirler plate, wherein the supplementary swirl holes are configured to maintain a flame in the combustion chamber when a supply pressure of the mixed gas suddenly drops.

2. A swirler plate for a gas burner as claimed in claim 1, wherein the supplementary swirl holes are formed such that they will be opposite to spray holes of a gas spray nozzle adjacent the swirler plate.

3. A swirler plate for a gas burner as claimed in claim 2, further comprising a center supplementary swirl hole located at a center of the swirler plate.

4. A swirler plate for a gas burner as claimed in claim 1, wherein the supplementary swirl holes have a diameter that is approximately one to three times a thickness of the swirler plate.

5. A swirler plate as claimed in claim 4, wherein the plurality of supplementary swirl holes are configured such that a mixed gas supplied to the combustion chamber through the supplementary swirl holes will remain lit if a pressure of a supplied gas temporarily decreases.

6. A swirler plate as claimed in claim 1, wherein one of the plurality of swirl vanes is a flame detector vane that is configured to guide mixed gas toward a flame detector, and wherein the flame detector vane has a slope angle that is smaller than slope angles of other swirl vanes.

7. The swirler plate as claimed in claim 6, wherein the flame detector vane is configured to have a combustion main reaction region in an area where the flame detector is fitted.

8. The swirler plate as claimed in claim , wherein the flame deteoctr vane has a slope angle that is approximately 20–25% smaller than the slope angles of other swirl vanes.

9. The swirler plate as claimed in claim 8, wherein the flame detector vane has a slope angle that is approximately 30% smaller than the slope angles of other swirl vanes.

10. The swirler plate as claimed in claim 1, wherein one of the plurality of swirl vanes is an ignition vane that is configured to guide mixed gas toward an ignition plug that lights the mixed gas, and wherein the ignition vane is configured to concentrate the supplied mixed gas immediately adjacent the ignition plug.

11. The swirler plate as claimed in claim 10, wherein a projection is formed on the ignition vane to concentrate the supplied mixed gas immediately adjacent the ignition plug.

12. The swirler plate as claimed in claim 11, wherein the projection is formed on a central portion of the ignition vane.

13. The swirler plate as claimed in claim 10, wherein one of the plurality of swirl vanes is a flame detector vane that is configured to guide mixed gas toward a flame detector, and wherein the flame detector vane has a slope angle that is smaller than slope angles of other swirl vanes.

14. The swirler plate as claimed in claim 13, wherein the flame detector vane is configured to have a combustion main reaction region in a area where the flame detector is fitted.

15. The swirler plate as claimed in claim 13, wherein the flame detector vane has a slope angle that is approximately 20 . 50% smaller than the slope angles of other swirl vanes.

16. The swirler plate as claimed in claim 1, wherein the swirler plate is approximately circular, and wherein the slits extend in a radial direction.

17. A swirler plate for a gas burner, comprising:

a plate having a plurality of slits formed therein for supplying a mixed gas from a first side of the swirler plate to a combustion chamber located adjacent a second side of the swirler plate;

a plurality of swirl vanes formed on the swirler plate, wherein the swirl vanes are configured to guide the mixed gas from the slits to the combustion chamber; and a plurality of secondary swirl holes formed in a central portion of the plate, wherein the secondary swirl holes are also configured to supply the mixed gas to the combustion chamber, and wherein the plurality of secondary swirl holes are configured to maintain a flame in the combustion chamber when a supply pressure of the mixed gas suddenly drops.

18. The swirler plate of claim 17, wherein the supplementary swirl holes are configured such that a mixed gas supplied to the combustion chamber through the supplementary swirl holes will remain lit if a pressure of a supplied gas temporarily decreases.

19. The swirler plate of claim 17, wherein one of the swirl vanes comprises a flame detector vane, wherein the flame detector vane is configured to guide the mixed gas toward a flame detector positioned in the combustion chamber, and wherein the flame detector vane has a slope angle that is smaller than slope angles of other swirl vanes.

20. The swirler plate of claim 19, wherein one of the swirl vanes comprises an ignition vane that is configured to concentrate the supplied mixed gas immediately adjacent an ignition plug that is positioned in the combustion chamber.

* * * * *